US006517014B1

(12) United States Patent
Ruehle et al.

(10) Patent No.: US 6,517,014 B1
(45) Date of Patent: Feb. 11, 2003

(54) FUEL INJECTION VALVE

(75) Inventors: Wolfgang Ruehle, Ditzingen (DE); Hubert Stier, Asperg (DE); Matthias Boee, Ludwigsburg (DE); Guenther Hohl, Stuttgart (DE); Norbert Keim, Loechgau (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/763,272

(22) PCT Filed: May 26, 2000

(86) PCT No.: PCT/DE00/01727

§ 371 (c)(1),
(2), (4) Date: Jul. 31, 2001

(87) PCT Pub. No.: WO00/79121

PCT Pub. Date: Dec. 28, 2000

(30) Foreign Application Priority Data

Jun. 19, 1999 (DE) ..... 199 28 205

(51) Int. Cl.[7] ..... F02M 51/06
(52) U.S. Cl. ..... 239/585.1
(58) Field of Search ..... 123/490, 498, 123/499; 239/584, 585.1, 585.2, 585.3, 585.4, 585.5; 251/129.01, 129.09, 129.15

(56) References Cited

U.S. PATENT DOCUMENTS 5,482,213 A 1/1996 Masanobu et al. ..... 239/584
6,311,950 B1 * 11/2001 Kappel et al. ..... 251/129.06
6,400,066 B1 * 6/2002 Sumrak et al. ..... 123/472
6,405,942 B1 * 6/2002 Ruehle et al. ..... 239/102.1

FOREIGN PATENT DOCUMENTS

DE 195 34 445 3/1997

* cited by examiner

*Primary Examiner*—Tony M. Argenbright
*Assistant Examiner*—Hai H. Huynh
(74) *Attorney, Agent, or Firm*—Kenyon & Kenyon

(57) ABSTRACT

A fuel injector, particularly an injector for fuel-injection systems of internal combustion engines, has a piezoelectric or magnetostrictive actuator and a valve-closure member which is operable by the actuator with the aid of a valve needle and which cooperates with a valve-seat surface to form a sealing seat. The actuator, at a first end face, abuts against a supporting member that has at least one cut-out through which at least one segment of an actuating sleeve projects. The actuating sleeve, at a first end, acts upon the valve needle, and at a second end, embraces the actuator at a second end face of the actuator facing away from the first end face of the actuator.

9 Claims, 1 Drawing Sheet

FUEL INJECTION VALVE

FIELD OF THE INVENTION

The present invention relates to fuel injectors.

BACKGROUND INFORMATION

The German Patent No. DE 195 34 445 C2 describes a fuel injector. The fuel injector described in this document has an actuator disposed in an actuator space, and a valve-closure member which is operable by the actuator with the aid of a valve needle and which cooperates with a valve-seat surface to form a sealing seat. The valve needle is joined with form locking to a pressure shoulder via which the actuator acts upon the valve needle against the force of a compression spring. The pressure shoulder and the valve needle are guided in a valve housing. The actuator has a centric opening through which the valve needle projects, the actuator being braced on one side against a pressure plate and on the other side against the pressure shoulder. When the actuator expands, the valve needle is actuated contrary to the spray-discharge direction.

A disadvantage in the fuel injector known from DE 195 34 445 C2 is that the actuator has a centric opening for achieving the reversal of movement. Therefore, special actuators must be manufactured for this model type, this manufacturing also being costly. In addition, the actuator must achieve specific predefined characteristic values, particularly with respect to stability and actuating force, which is made difficult by the centric bore hole, so that the ring-shaped actuator has a considerably larger diameter compared to a solid actuator.

In summary, the known mechanical transmitting device for actuating a fuel injector, opening to the inside, with the aid of an actuator is costly.

SUMMARY OF THE INVENTION

In contrast, the fuel injector of the present invention has the advantage that any actuators can be used, particularly solid actuators without an internal bore hole. In addition, the fuel injector according to the invention can be implemented using simple components, thus permitting savings on production costs.

The supporting member is advantageously attached, preferably by welding, to a valve housing of the fuel injector. This yields a simple specific embodiment in which, in response to actuation of the actuator, the actuating sleeve moves toward the supporting member which is fixedly secured in the valve housing.

It is advantageous that the actuating sleeve has three segments arranged in relation to an axis of the actuating sleeve in a manner that they are offset by at least approximately 120° relative to each other. This yields an actuating sleeve for which, with low structural expenditure, a uniform distribution of an actuating force of the actuator is provided over the periphery of the actuating sleeve.

It is also advantageous that the supporting member has three cut-outs arranged in relation to an axis of the fuel injector in a manner that they are offset by at least approximately 120° relative to each other, and that at least one segment of the actuating sleeve projects through each cut-out. In this manner, a supporting member is provided which has cut-outs distributed uniformly over the periphery of the actuating sleeve, and at the same time exhibits high stability for receiving the actuating force of the actuator.

The segments of the actuating sleeve are advantageously joined at the first end of the actuating sleeve to a valve-needle plate joined to the valve needle. This yields a simple specific embodiment in which the actuator acts directly on the valve needle via the actuating sleeve.

It is advantageous that, at its second end, the actuating sleeve has a contact plate which is joined to the segments of the actuating sleeve. In this manner, an embodiment of the actuating sleeve is provided which is structurally simple to implement. In addition, the contact plate forms a flat surface against which an actuator abuts in a planar manner with a flat second end face, thereby yielding advantageous transmission of the actuating force of the actuator to the actuating sleeve.

Prestressing is advantageously applied to the actuator by a prestress spring acting on the actuator via the contact plate of the actuating sleeve. This permits a compact fuel-injector construction.

The actuating sleeve and/or the pressure plate are advantageously produced by cold-forming a metallic material. The actuating sleeve and/or the pressure plate are thereby resistant to aging and insensitive to heat; advantageous removal of the heat, developing during actuation of the actuator, from the actuator to a valve housing of the fuel injector and to the fuel is additionally provided. Furthermore, this type of production is cost-effective.

DETAILED DESCRIPTION

Figure 1:
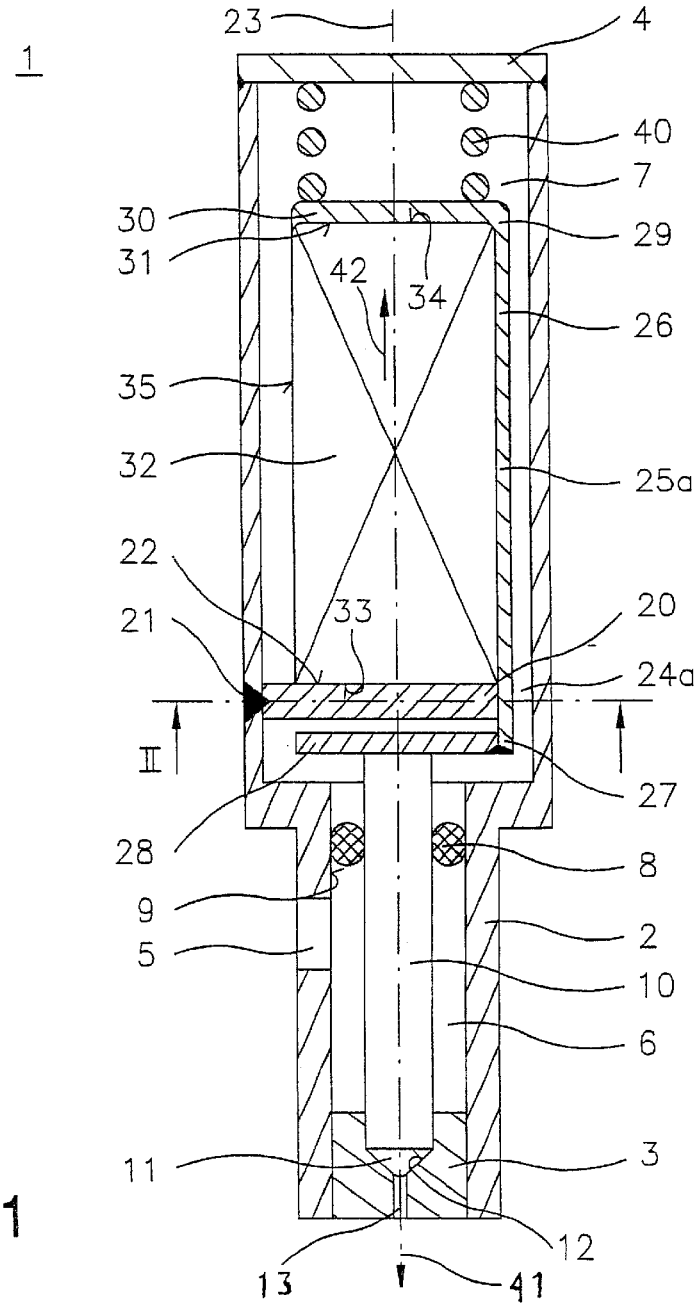
FIG. 1 shows an axial intersection through an exemplary embodiment of a fuel injecter according to the present invention.

FIG. 1, in a partial axial sectional view, shows a fuel injector 1 according to the present invention. Fuel injector 1 is used as a so-called direct gasoline injector for the direct injection of fuel, particularly gasoline, into a combustion chamber of a mixture-compressing internal combustion engine with externally supplied ignition. However, fuel injector 1 of the present invention is suitable for other applications as well.

In order to achieve a desired quantity and distribution of fuel in the combustion chamber of the internal combustion engine when working with a fuel injector for direct injection of fuel into a combustion chamber of an internal combustion engine, it is useful to design fuel injector 1 as an injector 1 opening to the inside.

Fuel injector 1 has a valve housing 2, a valve-seat member 3 secured at the spray-discharge end of valve housing 2, and a valve cover 4 which is joined to valve housing 2 at the end of valve housing 2 opposite valve-seat member 3. In addition, valve housing 2 has a cut-out 5 through which a fuel inlet connection is provided disposed laterally on fuel injector 1. To prevent fuel, flowing via cut-out 5 into a fuel chamber 6 of valve housing 2, from penetrating into an actuator space 7 of fuel injector 1, fuel chamber 6 is sealed off from actuator space 7 by a sealing element 8, particularly by an annular plastic seal which can be made of an elastomer. Sealing element 8 abuts against an inner surface 9 of valve housing 2 and against a valve needle 10. Valve needle 10 is joined to a valve-closure member 11 which cooperates with a valve-seat surface 12, formed on valve-seat member 3, to form a sealing seat. When valve needle 10 is actuated, valve-closure member 11 lifts off of valve-seat surface 12 of valve-seat member 3, fuel thereby flowing out of fuel chamber 6, preferably via swirl grooves, not indicated, which are formed in valve needle 10 and/or valve-closure member 11, into a spray orifice 13, and from there is sprayed out of fuel injector 1.

Located in actuator space 7 is a disk-shaped supporting member 20 which is welded by a welded seam 21 to valve housing 2 of fuel injector 1. A contact surface 22 of supporting member 20 is oriented perpendicularly to a valve axis 23 of fuel injector 1. Supporting member 20 has three cut-outs 24*a*, 24*b*, 24*c*, of which only cut-out 24*a* is visible in the sectional view according to FIG. 1. One of segments 25*a*, 25*b*, 25*c* of an actuating sleeve 26 projects through each of cut-outs 24*a*, 24*b*, 24*c*, only segment 25*a* being visible in the sectional view. Actuating sleeve 26 is joined at its first end 27 to a valve-needle plate 28 which is joined to valve needle 10. Actuating sleeve 26, at its second end 29, has a contact plate 30 which is joined to segments 25*a*, 25*b*, 25*c* of actuating sleeve 26. A contact surface 31 of contact plate 30 is oriented perpendicularly to valve axis 23.

Arranged in actuator space 7 of fuel injector 1, between supporting member 20 and contact plate 30, is a piezoelectric or magnetostrictive actuator 32 which is oriented along valve axis 23. At a flat first end face 33 of actuator 32, actuator 32 abuts in a planar manner against flat contact surface 22 of supporting member 20. At flat second end face 34 of actuator 32, actuator 32 abuts in a planar manner against flat contact surface 31 of contact plate 30. In this context, first end face 33 and second end face 34 are facing away from one another and in each case are oriented perpendicularly to valve axis 23. Segments 25*a*, 25*b*, 25*c* of actuating sleeve 26 are arranged about a lateral surface 35 of actuator 32, segments 25*a*, 25*b*, 25*c* abutting against lateral surface 35 of actuator 32 in this exemplary embodiment. Since segments 25*a*, 25*b*, 25*c* are oriented so that they are at least approximately parallel to valve axis 23, segments 25*a*, 25*b*, 25*c* are oriented at least approximately perpendicularly to contact plate 30 and disk-shaped supporting member 20, which means at second end face 34 of actuator 32, actuating sleeve 26 embraces actuator 32 with contact plate 30 of actuating sleeve 26.

Also arranged in actuator space 7 is a compression spring 40 which is braced on one side against valve cover 4 that is joined to valve housing 2, and is braced on the other side against contact plate 30 of actuating sleeve 26. Compression spring 40 applies a prestress to actuator 32, compression spring 40 acting upon contact plate 30 of actuating sleeve 26 in the direction of the sealing seat formed by valve-closure member 11 and valve-seat surface 12 of valve-seat member 3.

In response to actuation, actuator 32 expands, it bracing itself against supporting member 20 joined to valve housing 2 of fuel injector 1, and therefore moving actuating sleeve 26 against the force of compression spring 40 in actuator space 7. In this context, actuator 32 acts upon contact plate 30 of actuating sleeve 26 which is joined to valve-needle plate 28 via segments 25*a*, 25*b*, 25*c*. Therefore, actuator 32 acts upon valve-closure member 11 of valve needle 10 via actuating sleeve 26, which means that when actuator 32 is actuated, valve-closure member 11 lifts off of valve-seat surface 12 of valve-seat member 3, and the sealing seat is opened. Since, in response to an actuation of actuator 32, actuating sleeve 26 is moved contrary to discharge-spray direction 41 of fuel injector 1, valve-closure member 11 is also moved contrary to discharge-spray direction 41.

Therefore, in fuel injector 1 of the present invention, an actuating direction 42 of actuator 32 is reversed in the sense that actuating direction 42 of actuator 32 is oriented contrary to spray-discharge direction 41.

Figure 2:
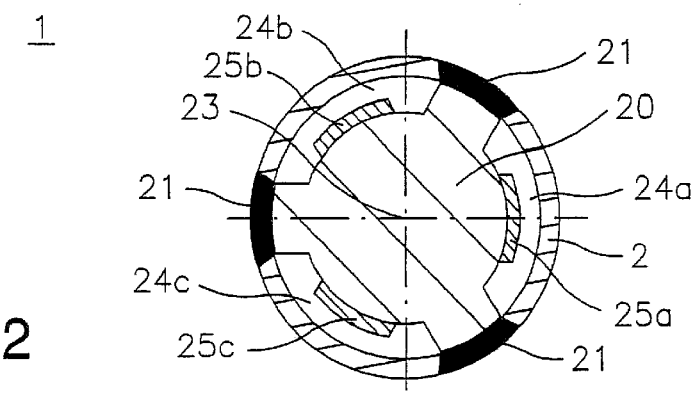
FIG. 2 shows an intersection along the line designated II in FIG. 1.

FIG. 2 shows an intersection, oriented perpendicularly to valve axis 23, through fuel injector 1 along the intersection line marked in FIG. 1 by II. Elements already described are provided with identical reference numerals.

Disk-shaped supporting member 20 is joined to valve housing 2 of fuel injector 1 by a welded seam 21 that is formed in three parts in this exemplary embodiment. The joining can also be effected using individual welding points or in another manner such as by hard-soldering or crimping. It is also possible to form in valve housing 2, a shoulder which has a support surface on which supporting member 20 is braced against the actuating force of actuator 32, so that supporting member 20 can also be arranged in valve housing 2 of fuel injector 1 without an integral attachment.

Supporting member 20 has cut-outs 24*a*, 24*b*, 24*c* which are arranged in relation to valve axis 23 in a manner that they are offset by at least approximately 120° relative to each other. One of segments 25*a*, 25*b*, 25*c* of actuating sleeve 26 projects through each of cut-outs 24*a*, 24*b*, 24*c*. Segments 25*a*, 25*b*, 25*c* of actuating sleeve 26 are arranged in relation to an axis of actuating sleeve 26, which in this exemplary embodiment coincides with valve axis 23, in a manner that they are offset by at least approximately 120° relative to each other. A plurality of segments of actuating sleeve 26 can also project through one cut-out of supporting member 20. It is also possible to provide a different number of cut-outs of supporting member 20 and/or of segments of actuating sleeve 26. In order to form supporting member 20 in a manner that is particularly cost-effective from the standpoint of materials, supporting member 20 can also be profiled, in particular it can be formed as a profiled sheet metal, so that contact surface 22 of supporting member 20 is no longer completely flat.

The invention is not restricted to the exemplary embodiment described. In particular, the invention can also be used in a fuel injector 1 opening to the outside. In addition, a special advantage of the invention can be seen in the fact that widely varying types of actuators can be used. Contact surface 22 of supporting member 20 and contact surface 31 of contact plate 30 can be adapted depending on the construction of first end face 33 and second end face 34 of actuator 32, so that an actuator 32 of any design can be reliably inserted between actuating sleeve 26 and supporting member 20.

What is claimed is:

1. A fuel injector for a fuel-injection system of an internal combustion engine, comprising:

an actuator, the actuator being one of a piezoelectric actuator and a magnetostrictive actuator, the actuator having first and second end faces, the second end face facing away from the first end face;

a valve needle;

a valve-seat surface;

a valve-closure member which is operable by the actuator with the aid of the valve needle and which cooperates with the valve-seat surface to form a sealing seat;

a supporting member that abuts against the first end face of the actuator, the supporting member having at least one cut-out; and an actuating sleeve having at least one segment that projects through the at least one cut-out of the supporting member, the actuating sleeve having a first end and a second end, the first end acting upon the valve needle, and the second end embracing the second end face of the actuator.

2. The fuel injector as recited in claim 1, wherein the supporting member is disk-shaped.

3. The fuel injector as recited in claim 1, further comprising:

a valve housing;

wherein the supporting member is attached to the valve housing by welding.

4. The fuel injector as recited in claim 1, wherein the actuating sleeve includes three segments which are arranged in relation to an axis of the actuating sleeve so that they are offset by at least approximately 120° relative to each other.

5. The fuel injector as recited in claim 1, wherein the supporting member has three cut-outs which are arranged in relation to a valve axis of the fuel injector so that they are offset by at least approximately 120° relative to each other, at least one of the at least one segment of the actuating sleeve projecting through each cut-out.

6. The fuel injector as recited in claim 1, wherein at the first end of the actuating sleeve, the at least one segment of the actuating sleeve is joined to a valve-needle plate joined to the valve needle.

7. The fuel injector as recited in claim 1, wherein the actuating sleeve includes a contact plate that is joined to the at least one segment at the second end of the actuating sleeve.

8. The fuel injector as recited in claim 7, further comprising:

a compression spring that acts on the actuator via the contact plate of the actuating sleeve, applying a prestress to the actuator.

9. The fuel injector as recited in claim 1, wherein at least one of the actuating sleeve and the supporting member are produced by cold-forming a metallic material.

* * * * *

UNITED STATES PATENT AND TRADEMARK OFFICE

CERTIFICATE OF CORRECTION

PATENT NO. : 6,517,014 B1
DATED : February 11, 2003
INVENTOR(S) : Wolfgang Ruehle et al.

It is certified that error appears in the above-identified patent and that said Letters Patent is hereby corrected as shown below:

Column 1,
Line 45, insert -- The supporting member is advantageously disk-shaped. The actuator thereby abuts with a flat first end face in a planar manner against a surface of the supporting member --.

Signed and Sealed this

Fourth Day of May, 2004

JON W. DUDAS
*Acting Director of the United States Patent and Trademark Office*